United States Patent [19]

Worley

[11] Patent Number: 4,971,197

[45] Date of Patent: Nov. 20, 1990

[54] BATTERY PACKAGE

[75] Inventor: Larry W. Worley, North Ridgeville, Ohio

[73] Assignee: Eveready Battery Company, Inc., St. Louis, Mo.

[21] Appl. No.: 446,993

[22] Filed: Dec. 6, 1989

[51] Int. Cl.[5] ..... B65D 75/02; B65D 71/00

[52] U.S. Cl. ..... 206/333; 206/497; 206/605

[58] Field of Search ..... 206/333, 497, 605

[56] References Cited

U.S. PATENT DOCUMENTS

| | | | |
|---|---|---|---|
| T889,029 | 8/1971 | Greenwell | 206/497 |
| T986,011 | 9/1979 | Affolter et al. . | |
| 2,205,437 | 6/1940 | Ringler . | |
| 2,671,731 | 3/1954 | Vogt . | |
| 3,175,752 | 3/1965 | Stabenow . | |
| 3,259,235 | 7/1966 | Sowle . | |
| 3,260,358 | 7/1966 | Gottily et al. . | |
| 3,338,404 | 8/1967 | Becker et al. . | |
| 3,344,975 | 10/1967 | Stoker, Jr. . | |
| 3,403,779 | 10/1968 | Becker et al. . | |
| 3,403,840 | 10/1968 | Mathes . | |
| 3,424,306 | 1/1969 | Munck . | |
| 3,442,436 | 3/1969 | Kirby, Jr. . | |
| 3,540,582 | 11/1970 | Wood . | |
| 3,747,749 | 7/1973 | Brown . | |
| 3,761,289 | 9/1975 | Wolf . | |
| 3,764,351 | 6/1973 | Whittington et al. | 206/497 |
| 3,863,837 | 2/1975 | Spiegel et al. . | |
| 4,077,516 | 3/1978 | Duerr . | |
| 4,119,202 | 10/1978 | Roth . | |
| 4,166,532 | 9/1979 | Tsnchida et al. . | |
| 4,254,869 | 3/1981 | Heier . | |
| 4,289,236 | 9/1981 | Ganz et al. . | |
| 4,323,156 | 4/1982 | Grueneberg . | |
| 4,696,402 | 9/1987 | Harmon et al. | 206/333 |
| 4,747,491 | 5/1988 | Ward . | |
| 4,756,415 | 7/1988 | Call . | |
| 4,782,956 | 11/1988 | Yoshizawa . | |

*Primary Examiner*—William I. Price

*Attorney, Agent, or Firm*—Virgil B. Hill

[57] ABSTRACT

A package for a plurality of dry cell batteries includes a heat shrinkable tube or sleeve dimensioned to receive the batteries in a tandem, side-by-side relationship. The tube is heat shrunk around the batteries to form a rigid set or package. A tear strip, affixed to an inner surface of the tube, extends between open ends of the tube. A plurality of the individual battery sets are arranged in a back-to-back grouping. An elongated, open-ended outer tube receives the grouped sets. The outer tube is heat shrunk around the sets to form a rigid package. An outer tear strip may be affixed to an undersurface of the outer tube to permit easy opening of the package.

5 Claims, 2 Drawing Sheets

BATTERY PACKAGE

BACKGROUND OF THE INVENTION

The present invention relates to packaging and more particularly to packages for dry cell batteries.

Dry cell batteries are marketed in a variety of different sizes Cylindrical batteries, for example, are sold in "AAA", "AA", "C" and "D" sizes In addition, nine volt dry cell batteries are sold in a rectangular shape. Various packages have been used for merchandising dry cell batteries. They may be packaged loose in a single box if sold in bulk Batteries are generally, however, sold in sets of two, four, six or eight in blister packages A blister package includes a cardboard sheet or backing and a relatively rigid plastic which retains the batteries on the sheet. The cardboard sheet may be formed with an aperture at a header portion thereof which permits the package to be suspended from an elongated display rod on a rack.

It has also been proposed to package dry cell batteries in shrink wrap packages. Such packages use a heat shrunk thermoplastic film which may be joined to a header board. Examples of prior packages may be found in U.S. Pat. Nos. 3,424,306 entitled Package and Method of Producing Same which issued on Jan. 28, 1969 to Munck; 3,863,837 entitled Cardless Head Board Merchandising Package which issued on Feb. 4, 1975 to Spiegel et al.; 4,166,532 entitled Package for Batteries and issued on Sept. 4, 1979 to Tsuchida et al.; and 4,747,491 entitled Tab-Opening Container which issued on May 31, 1988 to Ward et al.

Prior approaches have presented certain inherent problems to the consumer and the retailer. Prior packages have required excessive space to store and display the batteries. Generally, the dry cell batteries have not been conveniently packaged and hence sold in bulk. The consumer has been prevented from obtaining a cost savings In addition, prior packages have been difficult to open resulting in further inconvenience to the consumer. A need, therefore, exists for a battery package which provides convenience to the consumer, uses an absolute minimum of space and which can be economically mass produced.

SUMMARY OF THE INVENTION

In accordance with the present invention, the aforementioned needs are substantially fulfilled. Essentially, the package in accordance with the present invention incorporates a heat shrinkable tube or sleeve having open ends. A plurality of batteries are positioned within the sleeve which is shrunk around the batteries to form a relatively rigid package. A tear strip or length of tape is affixed to an undersurface of the tube. The tear strip includes an end which extends into one of the open ends of the tube. The tube covers the battery terminals.

In narrower aspects of the invention, a plurality of the individually packaged sets of batteries may be arranged in back-to-back relationship and positioned within a larger, elongated outer tube or sleeve The tube is heat shrunk around the assembled pairs of batteries to form a rigid, convenient, attractive and sturdy package. A nonperforated tear strip is positioned on an undersurface of the tube along the center line of the overall package. The tear strip may be pulled from one end of the package towards the opposite end. The consumer may, therefore, pull the tear strip only part of the way back so that individual sets of batteries are released while the remaining sets are securely retained in the package.

The present invention conveniently and attractively packages individual batteries in sets for bulk sales. The heat shrinkable sleeves or tubes may be preprinted or left clear. The tear strips permit easy access to the individual batteries. The retailer may store and/or display batteries using the absolute minimum of space.

DETAILED DESCRIPTION OF THE PREFERRED EMBODIMENT

Figure 3:
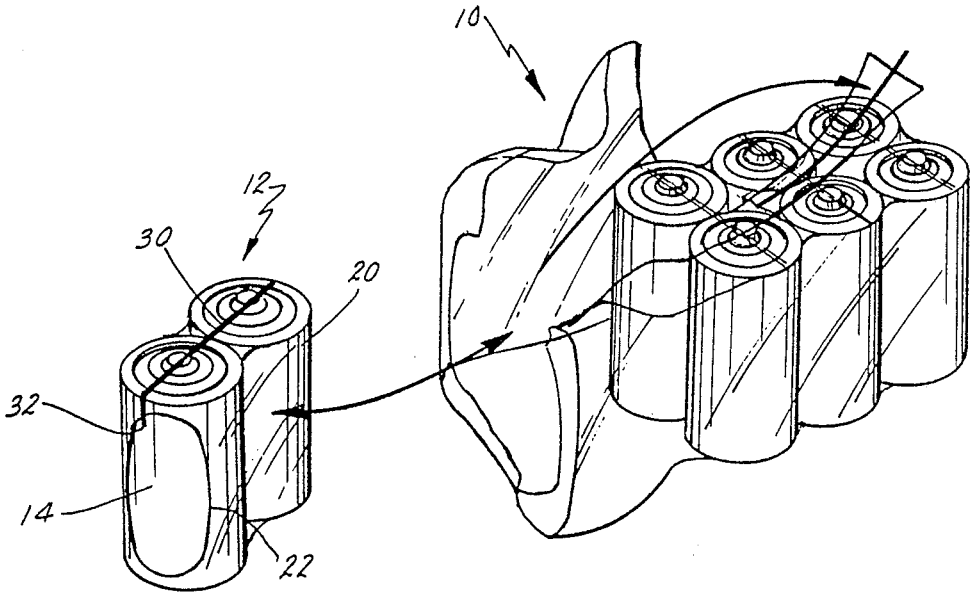
FIG. 3 is an exploded view showing a method of use of the package.

A preferred embodiment of a battery package in accordance with the present invention is illustrated in the drawings and generally designated by the numeral 10. Package 10 includes a plurality of individual sets 12 of dry cell batteries 14. The battery sets are arranged in a back-to-back relationship to form a pair of rows 16, 18 of batteries 14. The package 10 employs a "package within a package" concept As seen in FIG. 3, batteries 14 of each individual set 12 are individually packaged within a film tube or sleeve 20. In forming the set 12, tube or sleeve 20 is formed from a heat shrinkable film by joining edges of a sheet of film A pair of dry cells 14 are positioned within the tube or sleeve 20 in a tandem, side-by-side relationship. Tube 20 includes open ends 22. The batteries are oriented so that the sleeve covers the terminals and a portion of the cell's labels or sides may be seen through the open ends of the heat shrunk tubing. When heat is applied to the tubing, it shrinks around the cells and creates a rigid battery set or inner package.

Figure 4:
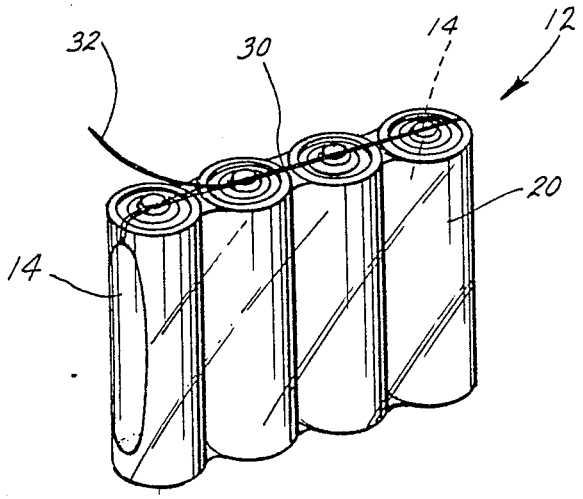
FIG. 4 is a perspective view showing the opening of an individual set of batteries.

Easy opening of the individual set or package 12 is achieved with a tear strip or tape 30 Strip 30 extends between open ends 22 of tube 20. Preferably tear strip 30 is a length of tape having an adhesive applied to one side thereof. The adhesive secures the tape to the undersurface of the tube 20. An end portion 32 extends into at least one of the open ends 22. End portion 32 may be conveniently grasped by the consumer to tear open the shrink wrap package. As shown in FIG. 4, sleeve 20 may be used to retain four dry cells 14 in a single rigid package. Generally, four of the AA size, four of the AAA size or four of the nine volt batteries could be conveniently retained in a single set. It is presently preferred that only two of the C and D size batteries be packed in a set.

Figure 1:
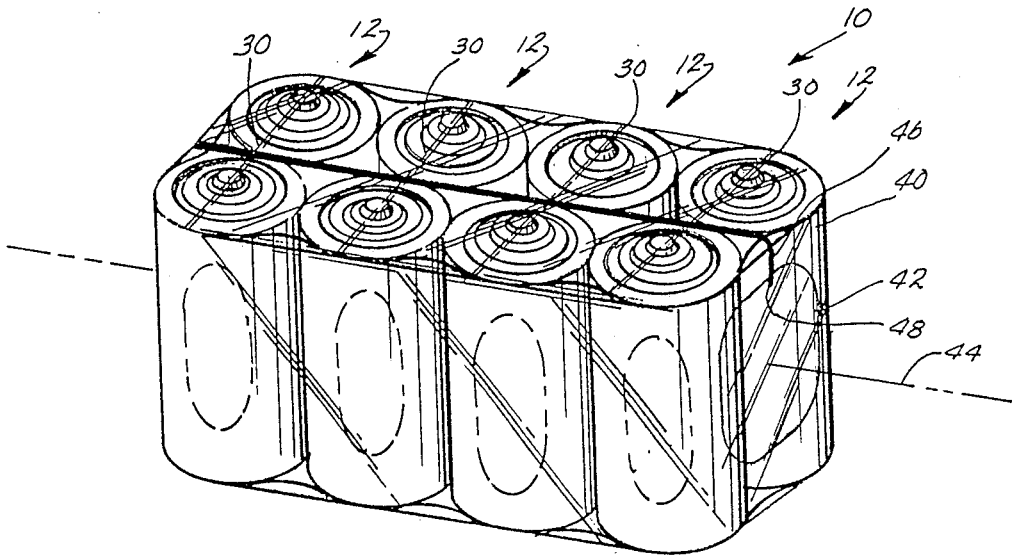
FIG. 1 is a perspective view of a battery package in accordance with the present invention.
Figure 2:
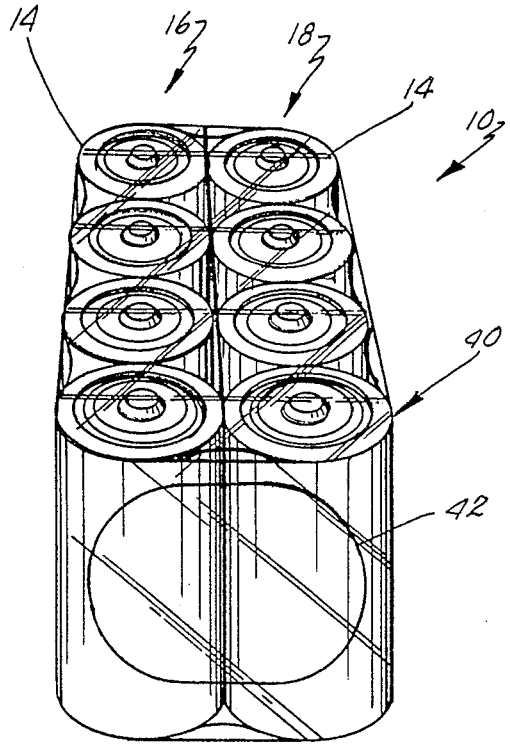
FIG. 2 is an end, perspective view of the battery package of FIG. 1.

After formation of the individual sets 12, they are arranged in back-to-back relationship to form a generally rectangular grouping In the package shown in FIGS. 1 and 2, four individual sets 12 define an 8-pack of batteries. The group of batteries are inserted into a larger diameter outer tube or sleeve 40. Sleeve 40 has open ends 42 and a longitudinal axis or centerline 44 which extends along and between the two rows 16, 18 of the batteries. The centerline 44 of sleeve 40 is perpendicular to tear strips 30 and the longitudinal axes of the individual tubes or sleeves 20.

An elongated tear strip or tape 46 is secured to the undersurface of tube 40. Tape 46 includes an end 48 extending into an open end 42 of tube 40. Strip 46 extends along the top surface of the package between the rows 16, 18 and parallel to centerline 44. Heat is used to shrink plastic tube 40 around the individual sets or packages 12. A convenient, attractive and sturdy package is thereby provided.

Tear strips 30, 46 are designed to be pulled from one end of the package to the opposite end thereof Tear strip 46 may be pulled only part way back along the center line of the package thereby dispensing one of the individual battery sets 12 as shown in FIG. 3. Outer sleeve 40 will still securely retain the remaining individual sets 12. It is preferred that the tear strips be formed from a plastic material which has a strength greater than that of the tubes 20, 40 and that nonperforated strips be employed. Perforating the film would weaken the physical integrity of the package. The package would not reliably enclose large size standard alkaline batteries such as C or D size batteries. The package must not be disposed to tearing or ripping during rough handling by the retailer and/or the consumer.

The package in accordance with the present invention defines a relatively rigid unit. The heat shrunk film securely retains the batteries and forms a package which takes up the absolute minimum space necessary. The consumer readily obtains the advantages of bulk purchase while retaining the convenience of dispensing cells in pairs when they are needed.

At present, it is preferred that the heat shrinkable film used to form tubes 20, 40 be a polyvinyl chloride resin. A typical film material formulation is as follows:

| Material | Percentage |
|---|---|
| PVC resin | 88% |
| Heat stabilizer (Cadmium, barium, zinc, tin, metallic soap systems) | 2–3% |
| Impact modifier (MBS rubber) | 2–5% |
| Processing aids (fatty acid esters) | 1% |

One such film may be obtained from CMS Gilbreth Packaging Systems of Trevose, Pa. Other commercially available shrink wrap films could also be used.

In view of the foregoing description, those of ordinary skill in the art may envision various modifications which would not depart from the inventive concepts disclosed It is expressly intended, therefore, that the above description should be considered as only that of the preferred embodiment The true spirit and scope of the present invention may be determined by reference to the appended claims.

The embodiments of the invention in which an exclusive property or privilege is claimed are as follows:

1. A battery package comprising:

a plurality of batteries, each battery including a label;

a heat shrinkable open ended sleeve dimensioned to receive said batteries in tandem, side-by-side relationship, said sleeve covering terminals of the batteries and shrink wrapping the batteries into a rigid package with portions of the battery labels showing through said open ends, said heat shrinkable sleeve being a PVC resin film; and a tear strip affixed to an inner surface of said sleeve, said strip extending between ends of the sleeve with a portion extending into one of said open ends.

2. A battery package as defined by claim 1 further comprising a plurality of said heat shrinkable, open ended sleeves each receiving a pair of batteries in tandem, side-by-side relationship, said sleeves arranged in back-to-back relationship to form a plurality of sets of batteries forming two rows along an elongated axis, each of said sleeves including a tear strip affixed to an undersurface thereof;

an elongated outer sleeve of a heat shrinkable film, said outer sleeve having a longitudinal axis extending generally along said elongated axis, said outer sleeve having open ends and being shrunk around said sets to retain said individual sets in a rigid package, each of said sleeves of said sets having an axis extending through their open ends which is perpendicular to the longitudinal axis of said outer sleeve; and an elongated outer tear strip secured to an undersurface of said outer sleeve and extending into one of said open ends thereof.

3. A battery package comprising:

a plurality of individual batteries separated into a plurality of battery sets;

a plurality of inner tubes, each inner tube being heat shrunk around one of said battery sets to form individually wrapped sets, said sets arranged in back-to-back, abutting relationship to form a generally rectangular grouping;

an outer tube heat shrunk around said grouping of individually wrapped sets, said outer tube having a pair of open ends;

a tear strip attached to an inner surface of said outer tube, said tear strip including an exposed end, said pack further including a plurality of individual tear strips each secured to an undersurface of one of said inner tubes, said inner tubes cover the terminals of said batteries of each set and the open ends of said inner tubes expose portions of the sides of said batteries, said inner tubes each having an axis extending through said open ends, and wherein said outer tube has a longitudinal axis which is generally perpendicular to the axes of said inner tubes.

4. A battery pack as defined by claim 3 wherein said inner tubes are PVC resin films.

5. A battery pack as defined by claim 4 wherein said outer tube is a PVC resin film.

* * * * *